United States Patent [19]

Binder, Jr.

[11] Patent Number: 4,671,357

[45] Date of Patent: Jun. 9, 1987

[54] METHOD OF CEMENTING A CASING IN A BOREHOLE

[75] Inventor: George G. Binder, Jr., Houston, Tex.

[73] Assignee: Exxon Production Research Co., Houston, Tex.

[21] Appl. No.: 884,307

[22] Filed: Jul. 15, 1986

Related U.S. Application Data

[63] Continuation of Ser. No. 655,970, Sep. 28, 1984, abandoned.

[51] Int. Cl.[4] ..... E21B 33/14; E21B 33/16

[52] U.S. Cl. ..... 166/291; 166/285

[58] Field of Search ..... 166/285, 291, 305.1; 252/8.55 R, 8.551

[56] References Cited

U.S. PATENT DOCUMENTS

| | | | |
|---|---|---|---|
| 2,776,112 | 1/1957 | Ilfrey et al. | 166/285 |
| 3,411,580 | 11/1968 | McKinney et al. | 166/285 |
| 3,653,441 | 4/1972 | Tuttle | 166/291 |
| 3,749,173 | 7/1973 | Hill et al. | 166/291 |
| 3,863,718 | 2/1975 | Bruist | 166/291 X |
| 3,878,895 | 4/1975 | Wieland et al. | 166/291 X |
| 3,884,302 | 5/1975 | Messenger | 166/291 |
| 4,190,110 | 2/1980 | Beirute | 166/291 |

*Primary Examiner*—George A. Suchfield

*Attorney, Agent, or Firm*—James H. Riley; Richard F. Phillips

[57] ABSTRACT

A method for cementing a casing into a borehole. The borehole is drilled to the desired depth in the usual manner. Before removing the drill string and without substantially interrupting the flow of fluids in the borehole, the mud therein is displaced with a fluid substantially free of undissolved solids from the portion of the borehole into which it is desired to cement the casing. When the solids-free fluid is in place, the drill string is removed, the casing suspended in the borehole, and a cement slurry placed in the annulus where it is allowed to set. Preferably, the solids-free fluid is more viscous and dense than the mud, and less viscous and dense than the cement slurry. Optionally, mutually compatible spacer fluids or cementing plugs are used to separate the mud from the solids-free fluid and the solids-free fluid from the cement slurry.

20 Claims, No Drawings

METHOD OF CEMENTING A CASING IN A BOREHOLE

CROSS REFERENCE TO RELATED APPLICATION

This application is a continuation application of U.S. patent application Ser. No. 655,970, filed Sept. 28, 1984, now abandoned.

FIELD OF THE INVENTION

This invention relates to cementing a casing in a borehole containing a well drilling circulation fluid. This invention relates particularly to a method for cementing the casing in which the circulation fluid is displaced by a high viscosity fluid, which in turn is displaced by a cementitious slurry, in a manner which eliminates excessive buildup of filter cake on the wall of the borehole.

BACKGROUND OF THE INVENTION

In the rotary drilling of wells, a drilling circulation fluid is circulated down the drill string, past the bit and back up to the surface in the annulus between the drill string and the borehole wall. The typical drilling fluid, or mud, contains water and/or oil, finely divided solids, and various additives which impart the desired gel strength, viscosity, weight and filtrate loss properties to the mud.

Typically, after the well has been drilled to a desired depth, a permanent casing is cemented in place. Cementing is accomplished by pumping a cementitious slurry into the annulus between the casing and the borehole wall where it is allowed to set, thus binding the casing to the formation. For the purposes of this invention, the term "casing" will apply to both casing and liner.

Obtaining a complete displacement of the circulating fluid in place in the annulus by the cement slurry is a primary consideration in cementing operations. Inadequate displacement of the mud leaves channels of gelled mud remaining in the annulus after the cement is in place which greatly reduces the effectiveness of the cementing operation. Moreover, the mud may contain components which prevent or delay the setting of the cement or reduce the strength of the set cement.

Removing the soft filter cake deposited by the mud on the borehole wall during the drilling operation is an equally important consideration. A soft filter cake presents an inadequate surface for bonding of the cement and is perhaps the most common cause of primary cementing failures. As this soft filter cake increases in thickness, the likelihood that the primary cementing job will fail also increases.

Because the drill bit must necessarily be as large or larger than the outside diameter of the casing, the drill string and bit must be withdrawn before the casing can be cemented in the borehole. The "tripping" of the drill string and suspending the casing takes considerable time, as much as twenty-four hours for deep wells. During this time, the drilling mud in the borehole cannot be circulated, and its gel strength has a tendency to increase when not in circulation, especially when subjected to high temperatures which may degrade the dispersants and thinners therein, requiring a high rate of shear to overcome the gel strength and re-initiate flow. Moreover, filtrate loss into the permeable formation results in buildup of filter cake during the trip of the drill string. Thus, the delay in cementing often results in ineffective displacement of the mud by the cement due to the increased gel strength and an ineffective bond between the cement and the borehole wall because of the filter cake that has been deposited.

There have been many attempts to eliminate the channeling of the mud as it is displaced by the cement slurry and to reduce the thickness of the deposited filter cake so that the bond of the cement to the borehole wall is improved. The mud is usually conditioned before tripping the drill string to ensure that drill cuttings are removed and the viscosity and gel strength are reduced. However, the mud still contains finely divided solids which cause filter cake to build up during the tripping of the drill string. These finely divided particles and the resultant filter cake have heretofore been thought to be essential to prevent the loss of the borehole fluids while tripping the drill string and suspending the casing.

One attempt to remove the filter cake involves the use of scratchers attached to the outside of the casing. The scratching appliance is a ring with flexible steel wires attached to it. As the casing is lowered into the borehole, it is reciprocated or rotated, and the scratchers stir the mud in place in the borehole and scratch off some of the filter cake. However, scratchers only agitate the mud in their localized vicinity. Moreover, movement of the casing must be maintained until the cement enters the annulus or the filter cake will reform.

Attempts to eliminate mud channeling include flushing the mud from the annulus after setting the casing, such as according to the method described in U.S. Pat. No. 3,884,302. While flushing may eliminate mud channeling in the cement, it has little effect in preventing formation of or removal of filter cake. There is described in U.S. Pat. No. 4,302,341 an effort to provide a preflushing or spacer fluid which aids in removing the filter cake by adding relatively large, angular solids to the preflushing fluid and flowing the fluid through the annulus at a high, turbulent flow rate. However, a high rate of flow results in an excessive downhole pressure which may fracture the formation, an event which requires time-consuming and expensive remedial operations. Moreover, reducing the flow rate or interrupting the flow will permit the filter cake to reform.

Another method for casing cementation is described in U.S. Pat. No. 3,653,441 in which a liquid slug having a graded viscosity is injected into the annulus ahead of the cement slurry. The liquid slug has a leading edge having a viscosity greater than the viscosity of the drilling mud and a trailing edge having a viscosity less than the viscosity of the cement slurry. As with the preflushing methods, the use of this graded viscosity slug does not provide for preventing filter cake buildup during removal of the drill string and suspension of the casing because the liquid slug contains undissolved solids, e.g. carbonate powder, used to control the viscosity.

In contrast to the methods heretofore known, the present invention provides a method of cementing a casing into a borehole in which there is no buildup of filter cake during removal of the drill string and suspension of the casing. The method of the present invention thus improves the bonding between the set cement and the formation.

SUMMARY OF THE INVENTION

The present invention is a method for cementing a casing into a borehole in which a rotary drill string is suspended and a drilling mud is circulated down the interior of the drill string, past the drill bit, through the annulus between the formation and the drill string, and back to the surface. Prior to removing the drill string and without interrupting the flow of mud already in the borehole, the mud is displaced from that portion of the borehole into which the casing is to be cemented by a fluid which is substantially free of undissolved solids. When the solids-free fluid is in place in the zone to be cemented, the circulation of fluid within the borehole is discontinued, the drill string is removed from the borehole, and a casing is suspended and cemented in the borehole according to one of the methods well-known in the art. Preferably, the solids-free fluid has a viscosity higher than that of the drilling mud but less than that of the cement slurry.

Displacing the drilling mud from that portion of the borehole into which the casing is to be cemented with the solids-free fluid according to the present invention eliminates the buildup of filter cake on the borehole wall during removal of the drill string and suspension of the casing in the borehole, thus improving the cement bond to the formation.

DETAILED DESCRIPTION OF THE PREFERRED EMBODIMENTS

Contrary to teachings in the industry, it has been discovered that during tripping of the drill string and suspending of the casing, the borehole fluid need not contain undissolved solids to prevent dispersion of the fluid into the formation. While the reasons are not definitely understood, it is believed that damage to the formation immediately around the borehole and the inevitable buildup of a thin (static) filter cake during drilling operations provide a sufficient barrier to prevent substantial dispersion of a solids-free fluid into the formation.

The solids-free fluid useful in the practice of this invention is an aqueous or oil based fluid which is substantially free from undissolved solids. Preferably, the solids-free fluid has a shear stress equal to or greater than the corresponding shear stress of the mud and equal to or less than the corresponding shear stress of the cement over all ranges of shear rates to which the cement, mud and solids-free fluid are subjected during displacement of the mud and the solids-free fluid from the borehole. The viscosity of the solids-free fluid may be modified by addition thereto of any appropriate viscosifier, including those well-known in the drilling art. A particularly preferred viscosifier is XC-polymer, produced in the bacterial digestion of sugar by genus *Xanthomonas campestris,* because its effects on viscosity do not depend on suspended solids and are not affected by electrolytes.

It is also preferred that the solids-free fluid have a density equal to or greater than that of the mud and equal to or less than that of the cemcnt. This preferred embodiment eliminates the effects of gravity fingering of the mud into the solids-free fluid and of the solids-free fluid into the cement. The solids-free fluid density may be modified by the addition thereto of densifiers well-known to the drilling art. It is important that any densifier used substantially dissolve in the solids-free fluid. Preferred densifiers include calcium chloride, calcium bromide and mixtures thereof. Other densifiers are also acceptable if they are substantially dissolved in the solids-free fluid and are otherwise compatible with the viscosifier.

According to the present invention, drilling of the borehole is performed in the usual manner by rotating the drill string and bit while circulating mud down the interior of the drill string, past the drill bit, through the annulus between the drill string and back to the surface. After the borehole is drilled to the desired depth, the mud may be conditioned to remove drill cuttings and to adjust the viscosity, gel strength, and filtrate loss properties. For best results, a wiper trip should be made through the entire stratum to be cemented to remove any excess filter cake on the borehole wall. This trip is especially important if the mud flow has been interrupted for any substantial length of time during the drilling of this stratum.

Without interrupting the circulation of the fluids after the final trip into the borehole, the mud therein is displaced by the solids-free fluid by injecting the solids-free fluid into the interior of the drill string, past the bit and into the annulus between the drill string and the borehole wall. The mud should not be allowed to stand in the borehole without circulating. If the mud is allowed to stand, filtrate loss into the formation will result in a buildup of filter cake. However, once the solids-free fluid has displaced the mud from that portion of the borehole wherein cementing will occur in accordance with the invention, the circulation of fluids within the borehole may be discontinued without risk of filter cake buildup in the cementing zone of the borehole.

The volume of the solids-free fluid injected should be sufficient to keep that portion of the borehole wall into which the casing is to be cemented completely covered with the solids-free fluid until the drill string and bit are removed, the casing suspended in the borehole, and a cement slurry placed in the annulus between the casing and the borehole wall. The precise volume of solids-free fluid depends in part on the volume displaced by the drill string and the rate of fluid loss into the formations.

After the solids-free fluid is in place as described above, the circulation of fluid through the drill string and annulus can be interrupted to remove the drill string and to suspend the casing. Because the fluid in contact with the borehole wall is substantially free of undissolved solids, there will be no additional filter cake buildup on the borehole wall occasioned by the loss of filtrate into the surrounding formation while the fluid in contact therewith is not circulating. Thus, when the cement slurry is placed in the annulus and allowed to set, an improved bond between the cement and the formation is obtained because of the much thinner filter cake on the borehole wall. Further, delays in removing the drill string or suspending the casing do not adversely affect the cementing operation.

When the casing is suspended, a cement slurry prepared according to the methods well-known in the art is placed in the annulus between the casing and the borehole wall and allowed to set in the usual manner. Preferably, the cement slurry will have a viscosity equal to or greater than that of the solids-free fluid in place in the annulus to minimize the effect of channeling. It is also preferred that the cement slurry have a density equal to or greater than that of the solids-free fluid in place in the annulus to eliminate the effect of gravity fingering.

In some instances, the solids-free fluid may not be compatible with the mud or cement slurry. In this event, it is possible to separate the mud from the solids-free fluid or the solids-free fluid from the cement slurry by injecting a mutually compatible spacer fluid between the incompatible liquids. It may also be desirable to separate the mud, solids-free fluid and cement slurry by positioning cementing plugs in the drill string or casing between the liquids.

The foregoing disclosure and description of the invention are illustrative and explanatory thereof, and various changes in the materials, as well as in the details of the illustrated method, may be made without departing from the spirit of the invention.

What is claimed is:

1. A method of cementing a casing into a borehole penetrating a subterranean formation, comprising the steps of:

circulating a substantially continuous flow of a drilling mud down the interior of a drill string, past a drill bit, through the annulus between the formation and the drill string, and back to the surface;

without substantially interrupting the circulation of the fluids in the borehole, displacing the mud from that portion of the portion of the borehole into which the casing is to be cemented with a fluid substantially free of undissolved solids and having a shear stress equal to or greater than that of the mud by injecting said solids-free fluid into the interior of the drill string, past the bit, and into the annulus, saud solids-free fluid being adapted to prevent the continued formation of filter cake on the walls of said borehole;

stopping circulation of the fluids in the borehole after the solids-free fluid has displaced the mud from that portion of the borehole into which the casing is to be cemented;

removing the drill string from the borehole;

suspending a casing in the desired portion of the borehole, thereby forming an annulus between said casing and the formation;

placing a cement slurry in said annulus between said casing and the formation; and allowing said cement slurry to set.

2. The method of claim 1, wherein said solids-free fluid has a density equal to or greater than that of the mud.

3. The method of claim 2, wherein said cement slurry has a density equal to or greater than that of said solids-free fluid.

4. The method of claim 1, wherein said cement slurry has a shear stress equal to or greater than that of the solids-free fluid at all rates of shear to which said cement slurry and said solids-free fluid are subject during said displacement.

5. The method of claim 1, wherein said cement slurry has a density equal to or greater than that of said solids-free fluid.

6. The method of claim 1, wherein said cement slurry has a shear stress equal to or greater than that of the solids-free fluid at all rates of shear to which said cement slurry and said solids-free fluid are subject during said displacement.

7. The method of claims 1, further comprising separating said solids-free fluid from the mud by injecting a cementing plug or a mutually compatible spacer fluid into the interior of the drill string ahead of said solids-free fluid.

8. The method of claim 1, further comprising separating said cement slurry from said solids-free fluid by injecting a cementing plug or a mutually compatible spacer fluid into the borehole ahead of said cement slurry.

9. A method of cementing a casing into a borehole penetrating a subterranean formantion, comprising he steps of:

circulating a substantially continuous flow of a drilling mud down the interior of a drill string, past a drill bit, through the annulus between the formation and the drill string, and back to the surface;

without substantially interrupting the circulation of the fluids in the borehole, displacing the mud from that portion of the borehole into which the casing is to be cemented with a fluid substantially free of undissolved solids by injecting said solids-free fluid into the interior of the drill string, past the bit, and into the annulus, said solids-free fluid having a density and a shear stress equal to or greater than that of the mud at all rates of shear to which said solids-free fluid and the mud are subject during said displacement, said solids-free fluid being adapted to prevent the continued formation of filter cake on the walls of said borehole;

stopping circulation of the fluids in the borehole after the solids-free fluid has displaced the mud from that portion of the borehole into which the casing is to be cemented;

removing the drill string from the borehole;

suspending a casing in the desired portion of the borehole, thereby forming an annulus between said casing and the formation;

placing a cement slurry in said annulus between said casing and the formation, said cement slurry having a density and a shear stress equal to or greater than that of the solids-free fluid; and allowing said cement slurry to set.

10. The method of claim 9, further comprising separating said solids-free fluid from the mud by injecting a cementing plug or a mutually compatible spacer fluid into the interior of the drill string ahead of said solids-free fluid.

11. The method of claim 9, further comprising separating said cement slurry from said solids-free fluid by injecting a cementing plug or a mutually compatible spacer fluid into the borehole ahead of said cement slurry.

12. A method of cementing a casing into a borehole penetrating a subterranean formation, comprising the the steps of:

circulating a water base drilling mud down the interior of a drill string, past a drill bit, through the annulus between the formation and the drill string, and back to the surface;

without substantially interrupting the circulation of the fluids in the borehole, displacing the mud from that portion of the borehole into which the casing is to be cemented with a fluid substantially free of undissolved solids by injecting said solids-free fluid into the interior of the drill string, past the bit, and into the annulus, said solids-free fluid being adapted to prevent the continued formation of filter cake on the walls of said borehole;

stopping circulation of the fluids in the borehole after the solids-free fluid has displaced the mud from that portion of the borehole into which the casing is to be cemented;

removing the drill string from the borehole;

suspending a casing in the desired portion of the borehole, thereby forming an annulus between said casing and the formation;

placing a cement slurry in said annulus between said casing and the formation; and allowing said cement slurry to set.

13. The method of claim 12, wherein said solids-free fluid is an aqueous based fluid.

14. The method of claim 13, wherein said solids-free fluid has a density equal to or greater than that of the mud.

15. The method of claim 14, wherein said solids-free fluid has a shear stress equal to or greater than that of the mud at all rates of shear to which said solids-free fluid and mud are subject during said displacement.

16. The method of claim 12, further comprising separating said solids-free fluid from the mud by injecting a mutually compatible spacer fluid into the interior of the drill string ahead of said solids-free fluid.

17. A method of cementing a casing into a borehole penetrating a subterranean formation in which the formation of filter cake on the walls of said borehole is prevented during the course of removing a drill string and suspending casing in said borehole, said method comprising the steps of:

circulating an oil base drilling mud down the interior of the drill string, past a drill bit, through the annulus between the formation and the drill string, and back to the surface;

displacing the mud from that portion of the borehole into which the casing is to be cemented with an oil based fluid which is substantially free of undissolved solids by injecting said solids-free fluid into the interior of the drill string, past the bit, and into the annulus, said solids-free fluid being substantially free of water, said solids-free fluid further being adapted to prevent the continued formation of filter cake on the walls of said borehole;

removing the drill string from the borehole;

suspending a casing in the desired portion of the borehole;

placing a cement slurry in the annulus intermediate said casing and the formation; and allowing said cement slurry to set.

18. The method of claim 17, wherein said solids-free fluid has a density equal to or greater than that of the mud.

19. The method of claim 17, wherein said solids-free fluid has a shear stress equal to or greater than that of the mud at all rates of shear to which said solids-free fluid and mud are subject during said displacement.

20. A method of cementing a casing into a borehole penetrating a subterranean formation in which the formation of filter cake on the walls of said borehole is prevented during the course of removing a drill string and suspended casing in said borehole, said method comprising the steps of:

circulating drilling mud down the interior of a drill string, past a drill bit, through the annulus between the formation and the drill string, and back to the surface, said drilling mud being adapted so that any filter cake formed during the drilling of said borehole does not congeal in contact with water;

displacing the mud from that portion of the borehole. into which the casing is to be cemented with a fluid substnatially free of undissolved solids by injecting said solids-free fluid into the interior of the drill string, past the bit, and into the annulus;

removing the drill string from the borehole;

suspending a casing in the desired portion of the borehole;

placing a cement slurry in the annulus intermediate said casing and the formation; and allowing said cement slurry to set.

* * * * *